US007486013B2

(12) United States Patent
Hong et al.

(10) Patent No.: US 7,486,013 B2
(45) Date of Patent: Feb. 3, 2009

(54) ELECTRON EMISSION DEVICE AND METHOD FOR MANUFACTURING THE SAME

(75) Inventors: Su-Bong Hong, Suwon-si (KR); Chun-Gyoo Lee, Suwon-si (KR); Sang-Jo Lee, Suwon-si (KR); Sang-Ho Jeon, Suwon-si (KR); Sang-Hyuck Ahn, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 379 days.

(21) Appl. No.: 11/394,058

(22) Filed: Mar. 29, 2006

(65) Prior Publication Data

US 2007/0029917 A1 Feb. 8, 2007

(30) Foreign Application Priority Data

Mar. 31, 2005 (KR) ..... 10-2005-0026988

(51) Int. Cl.
*H01J 1/62* (2006.01)
*H01J 63/04* (2006.01)

(52) U.S. Cl. ..... 313/495; 313/310

(58) Field of Classification Search ..... 313/308, 313/310, 495–497

See application file for complete search history.

(56) References Cited

U.S. PATENT DOCUMENTS 5,536,993 A 7/1996 Taylor et al.
5,786,659 A 7/1998 Takagi et al.
5,838,095 A * 11/1998 Tanaka et al. ..... 313/309
2003/0107311 A1 * 6/2003 Radigan et al. ..... 313/495
2005/0040752 A1 2/2005 Lee et al.
2005/0052108 A1 3/2005 Motoi et al.
2005/0248527 A1 * 11/2005 Yoo ..... 313/496

FOREIGN PATENT DOCUMENTS

EP 1 542 258 A2 6/2005
EP 1 542 258 A3 9/2005

OTHER PUBLICATIONS

European Search Report dated Aug. 17, 2006, for EP 06111824.6, in the name of Samsung SDI Co., Ltd.

* cited by examiner

*Primary Examiner*—Karabi Guharay
*Assistant Examiner*—Bumsuk Won
(74) *Attorney, Agent, or Firm*—Christie, Parker & Hale, LLP

(57) ABSTRACT

An electron emission device includes a first substrate; a second substrate facing the first substrate and separated therefrom by a predetermined distance; cathode electrodes, each comprising first electrodes formed on the first substrate, and a plurality of second electrodes spaced apart from the first electrodes; electron emission regions formed on the plurality of second electrodes; resistance layers interconnecting the first electrodes and each of the plurality of second electrodes while surrounding the electron emission regions; an insulating layer positioned over the resistance layers and the cathode electrodes; and gate electrodes formed over the insulating layer.

16 Claims, 6 Drawing Sheets

ELECTRON EMISSION DEVICE AND METHOD FOR MANUFACTURING THE SAME

CROSS REFERENCE TO RELATED APPLICATION

This application claims priority to and the benefit of Korean Patent Application No. 10-2005-0026988 filed on Mar. 31, 2005 in the Korean Intellectual Property Office, the entire content of which is incorporated herein by reference.

BACKGROUND OF THE INVENTION

Generally, electron emission devices are classified into those using hot cathodes as an electron emission source, and those using cold cathodes as the electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

The FEA type electron emission device is based on the principle that when a material having a low work function or a high aspect ratio is used as an electron emission source, electrons are easily emitted from the electron emission source when an electric field is applied thereto under the vacuum atmosphere. A sharp-pointed tip structure based on molybdenum Mo or silicon Si, or a carbonaceous material, such as carbon nanotube, graphite and diamond-like carbon, has been developed to be used as an electron emission region.

With the common FEA type electron emission device, cathode electrodes, an insulating layer, and gate electrodes are sequentially formed on a first substrate, and openings are formed at the gate electrodes and the insulating layer. Electron emission regions are formed over the cathode electrodes within the openings. Phosphor layers and an anode electrode are formed on a surface of a second substrate facing the first substrate.

In operation, when scan driving voltages are applied to any one of the cathode and the gate electrodes, and data driving voltages are applied to the other electrode, electric fields are formed around the electron emission regions at the pixels where the voltage difference between the two electrodes exceeds the threshold value. Electrons are emitted from those electron emission regions. The emitted electrons are attracted by the high voltage applied to the anode electrode (a positive voltage of several hundreds to several thousands volts), and collide against the corresponding phosphor layers, thereby light-emitting them.

However, with this type of electron emission device, when electrons are emitted from the electron emission regions, some electrons are non-straightly diffused even though most of the electrons straightly proceed toward the corresponding phosphor layers. The diffused electrons land on the black layers disposed between the phosphor layers, and do not serve to emit the visible rays. Furthermore, the diffused electrons land on incorrect color phosphor layers at the neighboring pixels, and light-emit them so that the image quality is deteriorated.

As the cathode and the gate electrodes have an internal resistance, they may induce voltage drop and signal distortion during the driving of the electron emission device. Particularly when the cathode electrodes are formed with a transparent oxide layer such as indium tin oxide (ITO), they involve higher resistance compared to the case where they are formed with a metallic conductive layer such as aluminum (Al) or silver (Ag).

When the voltage drop and the signal distortion are made, the electric fields applied to the electron emission regions are differentiated per the pixels even when the same driving voltage is applied to all the pixels. As a result, the electron emission uniformity per pixel is deteriorated, and in a serious case, a distinct luminance difference is observed along the length of the cathode or the gate electrodes.

SUMMARY OF THE INVENTION

One exemplary embodiment of the present invention includes a first substrate; a second substrate facing the first substrate and separated therefrom by a predetermined distance; cathode electrodes, each comprising first electrodes formed on the first substrate, and second electrodes spaced apart from the first electrodes; electron emission regions formed on the second electrodes; resistance layers interconnecting the first electrodes and the second electrodes while surrounding the electron emission regions; an insulating layer positioned over the resistance layers and the cathode electrodes; and gate electrodes formed over the insulating layer.

The first electrodes may be provided at the cathode electrodes as a pair of first electrodes, and the second electrodes may be disposed between the pair of first electrodes. In one embodiment, the second electrodes are located at pixel regions defined on the first substrate, and the electron emission regions are formed on the second electrodes. In another embodiment, two or more of the second electrodes are provided at each pixel region defined on the first substrate, and one ore more of the electron emission regions are formed on each second electrodes.

The second electrodes may be formed with a transparent conductive oxide layer and the first electrodes may have a specific resistance lower than that of the second electrodes.

In one embodiment, the first electrodes are formed with a material selected from the group consisting of aluminum, molybdenum, silver, titanium, tungsten, chromium, and platinum. In another embodiment, the resistance layers are formed at pixel regions defined on the first substrate in one to one correspondence. The resistance layers may also contact a lateral surface of the electron emission regions, and may have a specific resistance of $10^6$-$10^{12}$ Ωcm.

The electron emission regions may be formed with a material selected from the group consisting of carbon nanotube, graphite, graphite nanofiber, diamond, diamond-like carbon, $C_{60}$, and silicon nanowire.

In one embodiment, the electron emission device also includes focusing electrodes positioned over the gate electrodes and being electrically insulated from the gate electrodes, and phosphor layers formed on a surface of the second substrate facing the first substrate, and an anode electrode formed on a surface of the phosphor layers.

A thickness of the resistance layers may be larger than that of the electron emission regions such that a top surface of the resistance layers is placed on a plane higher than a top surface of the electron emission regions.

One embodiment of a method of manufacturing an electron emission device includes (a) forming a pair of first electrodes on a first substrate with a metallic material, and forming second electrodes between the pair of first electrodes with a transparent conductive oxide material to thereby form a cathode electrode; (b) forming a resistance layer on the pair of first electrodes and the second electrodes, and forming openings in the resistance layer such that the openings partially expose the surface of the second electrodes; (c) forming an insulating layer and gate electrodes on the cathode electrodes and the resistance layers such that the insulating layer and gate electrodes have openings, respectively; and (d) forming electron emission regions on the second electrodes within the openings in the resistance layers.

The second electrodes may be formed with ITO, and the first electrodes may be formed with a material selected from the group consisting of aluminum, molybdenum, silver, titanium, tungsten, chromium, and platinum.

The forming the electron emission regions, in one embodiment, includes (a) applying a mixture of an electron emission material and a photosensitive material onto an entire surface of the first substrate; (b) illuminating the mixture with ultraviolet rays from a backside of the first substrate to harden the mixture filled within the openings in the resistance layers; and (c) thereafter, removing the mixture that is not hardened through developing, and drying and firing a remaining mixture.

A thickness of the electron emission regions may be thinner than that of the resistance layers such that a top surface of the resistance layers is placed on a plane higher than a top surface of the electron emission regions.

In another embodiment of an electron emission device includes a first substrate; a second substrate facing the first substrate and separated therefrom by a predetermined distance; a cathode electrode including a plurality of first electrodes formed on the first substrate, and a second electrode spaced apart from the plurality of first electrodes; at least one electron emission region formed on the second electrode; a resistance layer interconnecting the plurality of first electrodes and the second electrode while surrounding the at least one electron emission region; an insulating layer positioned over the resistance layer and the cathode electrode; and a gate electrode formed over the insulating layer. The second electrode may also be formed with a transparent conductive oxide layer.

DETAILED DESCRIPTION

Figure 1:
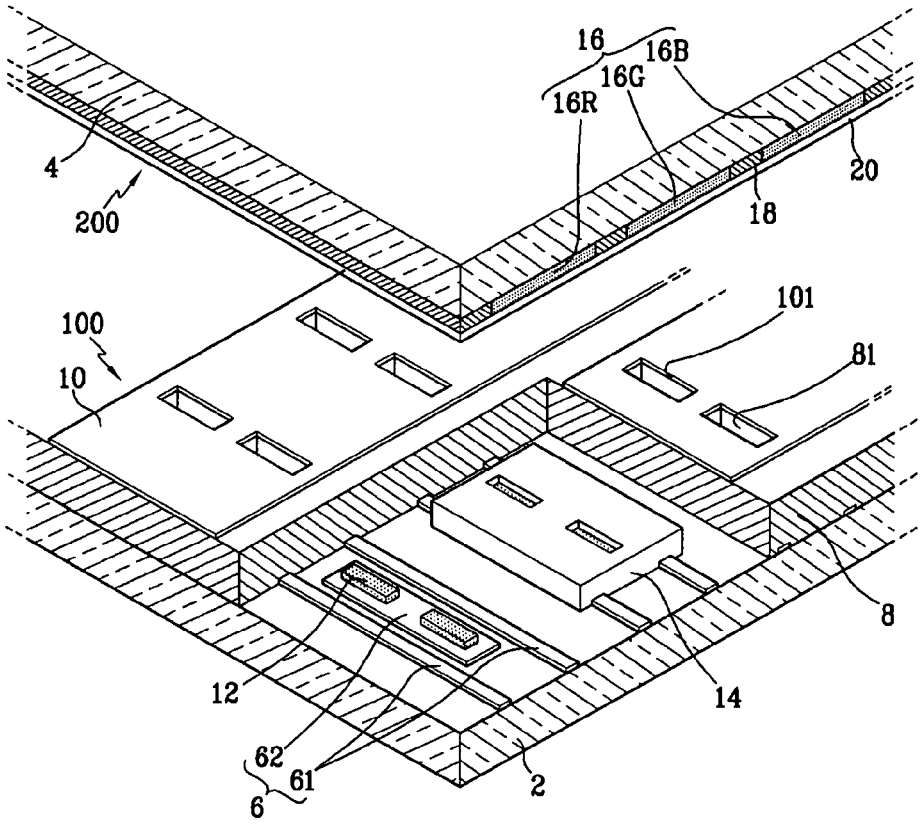
FIG. 1 is a partial exploded perspective view of an electron emission device according to a first embodiment of the present invention.
Figure 2:
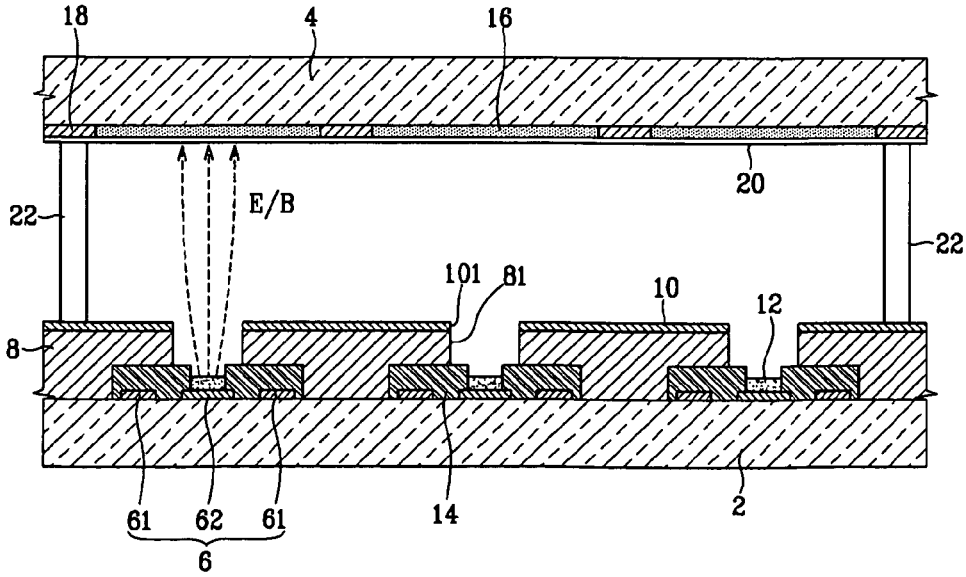
FIG. 2 is a partial sectional view of the electron emission device according to the first embodiment of the present invention.

As shown in FIGS. 1 and 2, an electron emission device according to an embodiment of the present invention includes first and second substrates 2 and 4 arranged parallel to each other with a predetermined distance therebetween. A sealing member (not shown) is provided at the peripheries of the first and the second substrates 2 and 4 to seal them to each other. That is, the first and the second substrates 2 and 4, and the sealing member form a vacuum envelope.

An electron emission unit 100 is provided on a surface of the first substrate 2 to emit electrons toward the second substrate 4, and a light emission unit 200 is provided on a surface of the second substrate 4 facing the first substrate 2 to emit visible rays due to the electrons.

Cathode electrodes 6 are stripe-patterned on the first substrate 2 in a first direction of the first substrate 2, and an insulating layer 8 is formed on the entire surface of the first substrate 2 while covering the cathode electrodes 6. Gate electrodes 10 are stripe-patterned on the insulating layer 8 perpendicular to the cathode electrodes 6.

In this embodiment, when the crossed regions of the cathode and the gate electrodes 6 and 10 are defined as pixel regions, electron emission regions 12 are formed over the cathode electrodes 6 at the respective pixel regions. Openings 81 and 101 are formed at the insulating layer 8 and the gate electrodes 10 corresponding to the electron emission regions 12 while exposing the electron emission regions 12 on the first substrate 2.

The electron emission regions 12 are formed with a material emitting electrons when an electric field is applied thereto under the vacuum atmosphere, such as a carbonaceous material, and a nanometer-sized material. The electron emission regions 12 may be formed with carbon nanotube, graphite, graphite nanofiber, diamond, diamond-like carbon, $C_{60}$, silicon nanowire or a combination thereof, by way of screen-printing, direct growth, chemical vapor deposition, or sputtering.

In this embodiment, each cathode electrode 6 includes a pair of first electrodes 61 arranged parallel to each other and separated by a predetermined distance, and second electrodes 62 disposed between the first electrodes 61 by a distance. The first electrodes 61 are connected to electrode pad portions (not shown) at one side end to receive driving voltages therefrom. The second electrodes 62 each are separately located at the respective pixel regions, and one or more electron emission regions 12 are placed over each second electrode 62.

Figure 3:
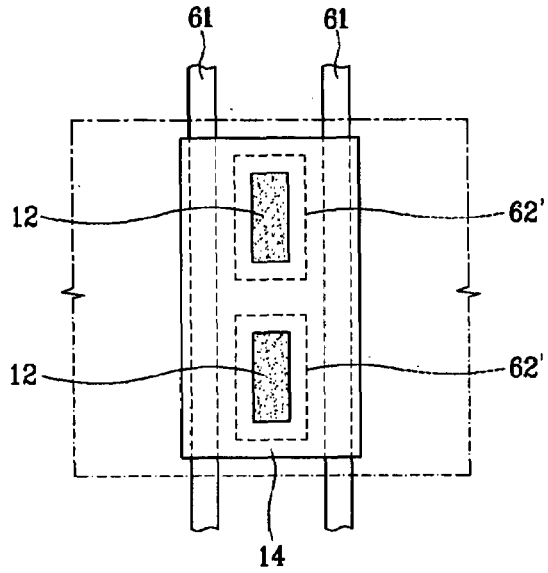
FIG. 3 is a partial plan view of the electron emission device according to another embodiment of the present invention, illustrating variants of the second electrode and the electron emission region thereof.

It is illustrated in the drawings that one second electrode 62 is located at each pixel region, and two electron emission regions 12 are placed over each second electrode 62. Alternatively, two or more second electrodes 62 may be located at each pixel region, and one or more electron emission regions 12 may be placed over each second electrode 62. It is illustrated in FIG. 3 that two second electrodes 62' are located at each pixel region, and one electron emission region 12 is placed over each second electrode 62'.

Referring again to FIGS. 1 and 2, with the process of forming the electron emission regions 12 to be explained later, the second electrodes 62 may be formed with a transparent oxide material, such as indium tin oxide (ITO), to transmit ultraviolet rays. The first electrodes 61 may be formed with a material having a specific resistance lower than that of the second electrodes 62, such as aluminum, molybdenum, silver, titanium, tungsten, chromium, and platinum.

Each second electrode 62 is electrically connected to a pair of first electrodes 61 via a resistance layer 14. The resistance layer 14 is separately provided at the respective pixel regions. That is, one resistance layer 14 is formed at each pixel region while covering the first and the second electrodes 61 and 62. The resistance layer 14 is formed with a conductive material having a specific resistance higher than that of the first and the second electrodes 61 and 62, for instance, a specific resistance of $10^6$-$10^{12}$ Ωcm.

The resistance layers 14 make the intensity of the electric current applied to the electron emission regions 12 uniform at the pixels arranged along the length of the cathode electrodes 6 when a voltage drop is made along the length of the cathode electrodes 6. With the resistance layers 14, the electron emission uniformity per pixel is enhanced, and the luminance is uniformly expressed.

In this embodiment, the resistance layer 14 surrounds the electron emission region 12 while contacting the lateral surface of the electron emission region 12. As all sides of the electron emission region 12 contact the second electrode 62 or the resistance layer 14 except for the top thereof, the contact resistance thereof with the cathode electrode 6 can be minimized, and in operation, electric fields are uniformly applied to the entire top surface thereof, thereby achieving uniform emission from that top surface.

Furthermore, in this embodiment, the top surface of the resistance layer 14 is placed on a plane higher than the top surface of the electron emission region 12. With the resistance layers 14, electric fields are formed around the electron emission regions 12 such that the electron beams can be well focused. That is, the resistance layer 14 functions as a focusing electrode for focusing the electrons emitted from the electron emission regions 12.

Phosphor layers 16 are formed on a surface of the second substrate 4 facing the first substrate 2 with red, green, and blue phosphor layers 16R, 16G and 16B spaced apart from each other by a distance, and black layers 18 are disposed between the respective phosphor layers 16 to enhance the screen contrast. An anode electrode 20 is formed on the phosphor layers 16 and the black layers 18 with a metallic material, such as aluminum.

The anode electrode 20 receives a high voltage required for accelerating the electron beams, and reflects the visible rays, radiated from the phosphor layers 16 toward the first substrate 2, back toward the second substrate 4, thereby heightening the screen luminance.

The anode electrode 20 may be formed with a transparent conductive material, such as ITO. In this case, the anode electrode is placed on a surface of the phosphor layers 16 and the black layers 18 facing the second substrate 4. The anode electrode may be formed on the entire area facing the second substrate 4, or patterned with a plurality of portions.

A plurality of spacers 22 are arranged between the first and the second substrates 2 and 4. The spacers 22 maintain a constant distance between the first and the second substrates 2 and 4, and support the vacuum envelope to prevent the breakage thereof. The spacers 22 are located corresponding to the black layers 18 such that they do not occupy the area of the phosphor layers 16.

The above-structured electron emission device is operated by applying predetermined voltages to the cathode electrodes 6, the gate electrodes 10, and the anode electrode 20. For instance, scan driving voltages are applied to any one of the cathode and the gate electrodes 6 and 10, and data driving voltages to the other electrode. A positive voltage of several hundred to several thousand volts is applied to the anode electrode 20.

Electric fields are formed around the electron emission regions 12 at the pixels where the voltage difference between the cathode and the gate electrodes 6 and 10 exceeds the threshold value, and electrons are emitted from the electron emission regions 12. The emitted electrons are attracted by the high voltage applied to the anode electrode 20, and collide against the corresponding phosphor layers 16, thereby causing them to emit light. In this process, with the electron emission device according to the present embodiment, the electron emission uniformity per pixel is enhanced by the resistance layers 14, and the beam spreading is minimized due to the electron beam focusing operation of the resistance layers 14.

Figure 4:
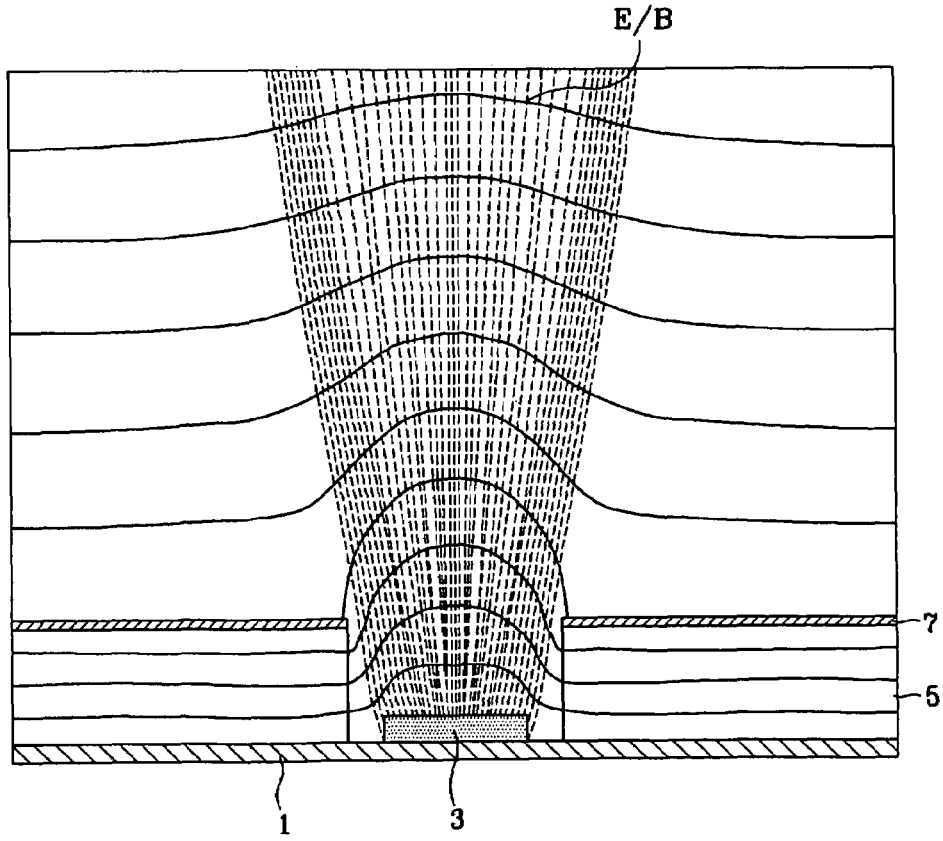
FIG. 4 is a schematic view of an electron emission device according to Comparative Example 1, simulating the trajectories of emitting electrons.
Figure 5:
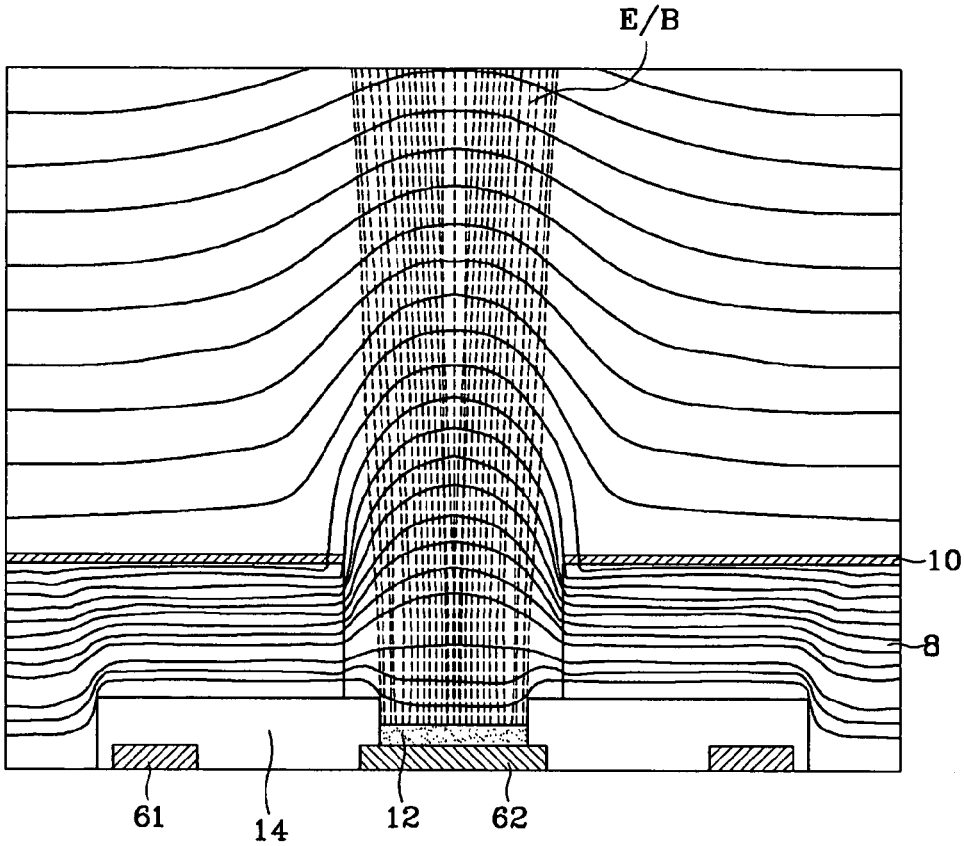
FIG. 5 is a schematic view of an electron emission device according to Example 1, simulating the trajectories of emitting electrons.

FIG. 4 is a schematic view of an electron emission device according to Comparative Example 1 where the cathode electrode 1 is stripe-shaped with no resistance layer, simulating the trajectories of emitting electron beams. FIG. 5 is a schematic view of an electron emission device according to Example 1, simulating the trajectories of emitting electron beams.

With the electron emission regions according to the Example 1 and the Comparative Example 1, the structural components were the same except for the shape of the cathode electrodes and the presence or absence of the resistance layers, and the simulations were made under the same voltage application condition.

With the electron emission device according to the Comparative Example 1, as shown in FIG. 4, equipotential lines are formed over the electron emission regions 3 such that they are concave toward the electron emission regions 3. With such a distribution of electric fields, when electrons are emitted from the electron emission regions 3, they are diffused with a relatively large diffusion angle. The reference numeral 5 of FIG. 4 indicates an insulating layer, and the reference numeral 7 indicates gate electrodes.

By contrast, with the electron emission device according to the Example 1, as shown in FIG. 5, equipotential lines are formed over the electron emission regions 12 such that they are convex toward the electron emission regions 12 due to the presence of the resistance layers 14. With additional distances away from the electron emission regions 12, the equipotential lines become flat and then concave toward the electron emission regions 12. With such a distribution of electric fields, the equipotential lines, which are convex toward the electron emission regions 12, significantly reduce the initial diffusion angle of the electron beams. Consequently, the electrons proceed toward the second substrate with excellent focusing capacity.

Consequently, the electrons emitted at a pixel do not tend to land on black layers or incorrect color phosphor layers at the pixel neighbors, but land on the correct color phosphor layer. Therefore, with the electron emission device according to this embodiment of the present invention, the abnormal light emitting is inhibited, and the color reproducibility and the color purity are enhanced, resulting in excellent screen image quality.

Figure 6:
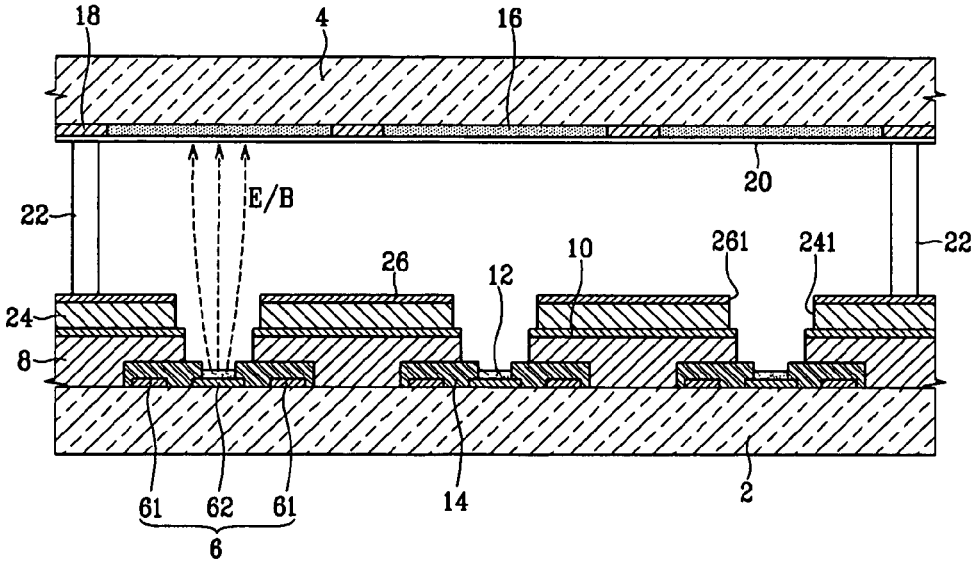
FIG. 6 is a partial sectional view of an electron emission device according to another embodiment of the present invention.

As shown in FIG. 6, an electron emission device according to another embodiment of the present invention basically has the same structural components as the electron emission device related to the embodiment discussed above, except that it further has a focusing electrode.

In this embodiment, when the insulating layer 8 disposed between the cathode and the gate electrodes 6 and 10 is defined as the first insulating layer, a second insulating layer 24 and a focusing electrode 26 are formed on the gate electrodes 10 and the first insulating layer 8. Openings 241 and 261 are respectively formed at the second insulating layer 24 and the focusing electrode 26. The openings 241 and 261 may be provided at the respective pixel regions with one-to-one correspondence, or a plurality of openings may be provided at each pixel region corresponding to the number of electron emission regions 12.

In operation, the focusing electrode 26 may receive a negative voltage of several to several tens of volts, and gives a repulsive force to the electrons passing the openings 261. Accordingly, with the electron emission device according to the present embodiment, the electrons once focused by the resistance layers 14 are re-focused while passing the openings 261 of the focusing electrode 26, thereby improving the electron beam focusing effect, compared to that related to the previous embodiment.

A method of manufacturing the electron emission device will be explained with reference to FIGS. 7A to 7G.

Figure 7A:
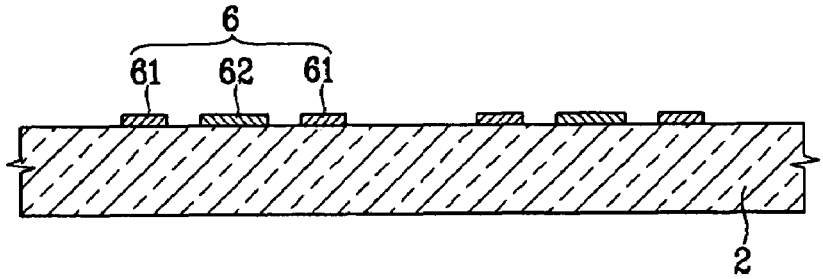
FIG. 7A illustrates a first phase of manufacturing the electron emission device according to one embodiment of the present invention.

As shown in FIG. 7A, a conductive film is coated on a first substrate 2 with a transparent oxide material such as ITO, and patterned to thereby form second electrodes 62. The second electrodes 62 may be separately placed at the respective pixel regions defined on the first substrate 2.

First electrodes 61 are formed at both sides of the second electrodes 62 along a first direction on the first substrate 2. The first electrodes 61 may be formed with a material having a specific resistance lower than that of the second electrodes 62, such as aluminum, molybdenum, silver, titanium, tungsten, chromium, and platinum, by way of screen printing, vacuum deposition, sputtering, chemical vapor deposition, or plating. The second electrodes 62 and the first electrodes 61 may alternatively be formed in reverse order.

Figure 7B:
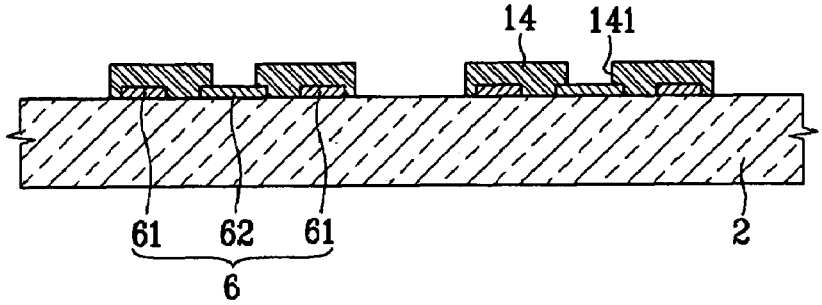
FIG. 7B illustrates a second phase of manufacturing the electron emission device according to one embodiment of the present invention.

As shown in FIG. 7B, a resistance layer 14 is formed on the first and the second electrodes 61 and 62 per the respective pixels regions defined on the first substrate 2. The resistance layers 14 are patterned to thereby form openings 141 to the electron emission regions. In one embodiment, the resistance layers 14 are formed through applying a material with a specific resistance of $10^6$-$10^{12}$ Ωcm by screen printing, and drying it.

Figure 7C:
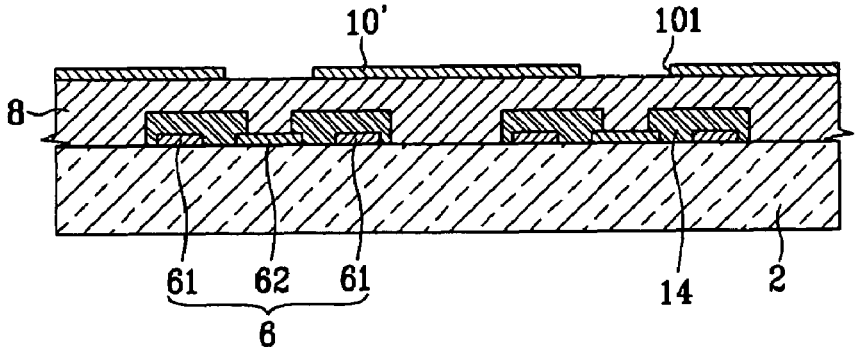
FIG. 7C illustrates a third phase of manufacturing the electron emission device according to one embodiment of the present invention.
Figure 7D:
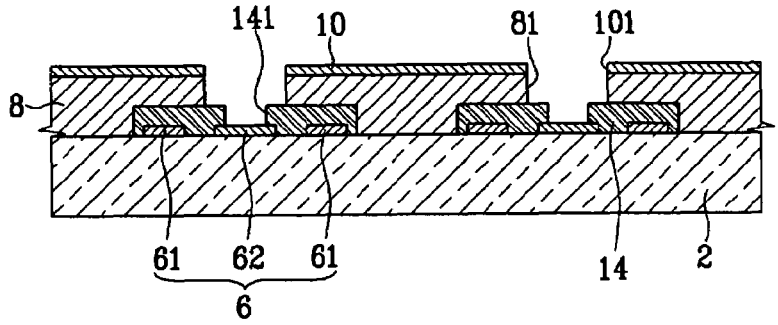
FIG. 7D illustrates a fourth phase of manufacturing the electron emission device according to one embodiment of the present invention.

Thereafter, as shown in FIG. 7C, an insulating layer 8 is formed on the entire surface of the first substrate 2, and a conductive layer 10' is formed on the insulating layer 8, followed by patterning the conductive layer 10' to form openings 101. As shown in FIG. 7D, the portions of the insulating layer 8 exposed through the openings 101 of the conductive layer 10' are removed through etching to thereby form openings 81 in the insulating layer 8. The conductive layer 10' is patterned perpendicular to the first electrodes 61 to thereby form gate electrodes 10.

Figure 7E:
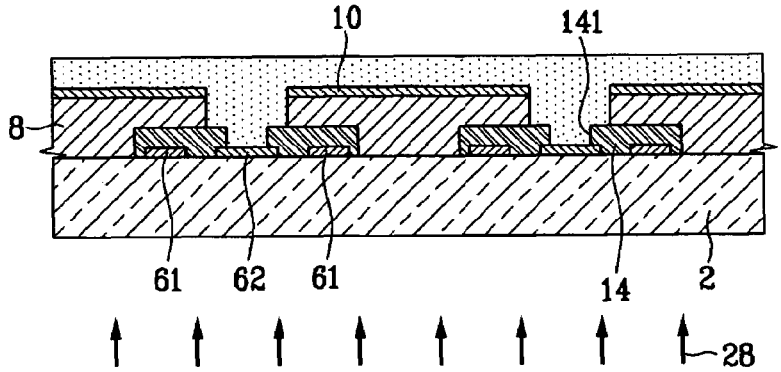
FIG. 7E illustrates a fifth phase of manufacturing the electron emission device according to one embodiment of the present invention.
Figure 7F:
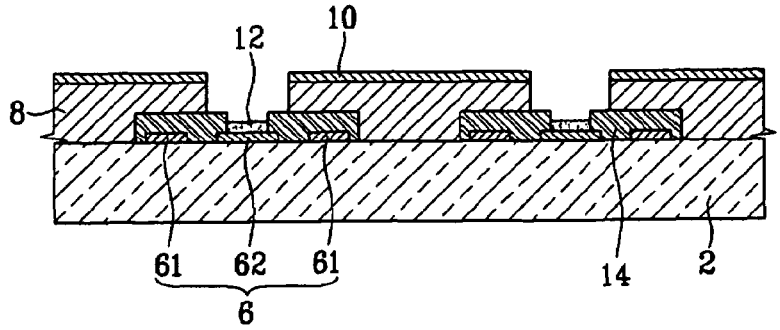
FIG. 7F illustrates a sixth phase of manufacturing the electron emission device according to one embodiment of the present invention.

As shown in FIG. 7E, a paste-phased mixture containing an electron emission material and a photosensitive material is applied onto the entire surface of the first substrate 2, and ultraviolet rays 28 are illuminated thereto from the backside of the first substrate 2 to selectively harden the mixture filled within the openings 141 of the resistance layers 14. The non-hardened mixture is removed through developing, and the hardened mixture is dried and fired, thereby forming electron emission regions 12 shown in FIG. 7F. At this time, the intensity of ultraviolet rays and the time of illumination are properly controlled such that the electron emission regions 12 have a height lower than the resistance layers 14.

With the backside light exposure technique, the mixture is hardened beginning from the surface of the second electrodes 62. The electron emission regions 12 are thus well attached to the cathode electrodes 6. In addition to the screen printing, the electron emission regions 12 may be formed through direct growth, chemical vapor deposition, or sputtering.

Figure 7G:
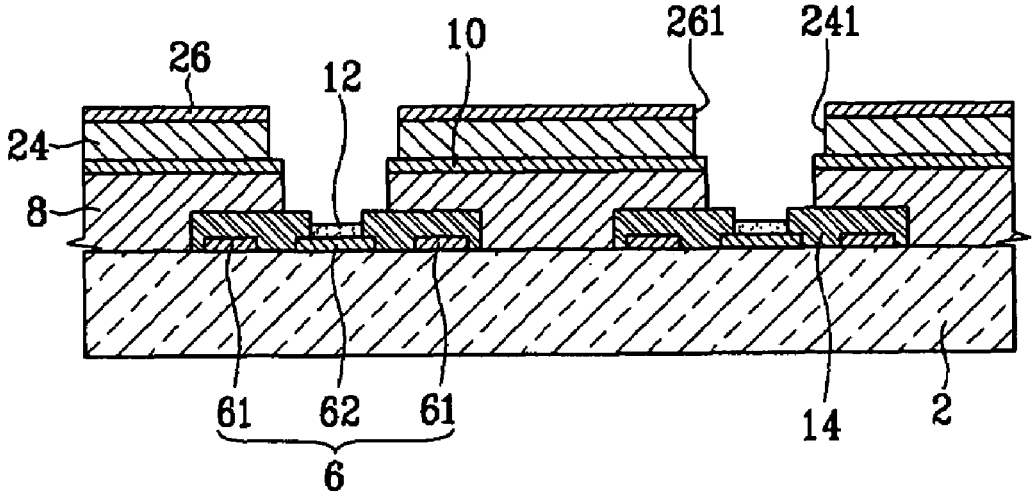
FIG. 7G illustrates a seventh phase of manufacturing the electron emission device according to one embodiment of the present invention.

As shown in FIG. 7G, when the insulating layer 8 disposed between the cathode and the gate electrodes 6 and 10 is defined as the first insulating layer, a second insulating layer 24 and focusing electrodes 26 are formed on the gate electrodes 10 and the first insulating layer 8 before the formation of the electron emission regions 12, and openings 261 and 241 are formed at the focusing electrode 26 and the second insulating layer 24, followed by forming the electron emission regions 12 on the second electrodes 62 in the above-described way. Consequently, an electron emission device with a focusing electrode 26 according to the embodiment shown in FIG. 6 is completed.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

a first substrate;

a second substrate facing the first substrate and separated therefrom by a predetermined distance;

cathode electrodes, each comprising first electrodes formed on the first substrate, and second electrodes spaced apart from the first electrodes;

electron emission regions formed on the second electrodes;

resistance layers interconnecting the first electrodes and the second electrodes while surrounding the electron emission regions;

an insulating layer positioned over the resistance layers and the cathode electrodes; and gate electrodes formed over the insulating layer.

2. The electron emission device of claim 1, wherein the first electrodes are provided at the cathode electrodes as a pair of first electrodes, and the second electrodes are disposed between the pair of first electrodes.

3. The electron emission device of claim 1, wherein the second electrodes are located at pixel regions defined on the first substrate, and one or more of the electron emission regions are formed on the second electrodes.

4. The electron emission device of claim 1, wherein two or more of the second electrodes are provided at each pixel region defined on the first substrate, and one or more of the electron emission regions are formed on each second electrode.

5. The electron emission device of claim 1, wherein the second electrodes are formed with a transparent conductive oxide layer.

6. The electron emission device of claim 5, wherein the first electrodes have a specific resistance lower than that of the second electrodes.

7. The electron emission device of claim 6, wherein the first electrodes are formed with a material selected from the group consisting of aluminum, molybdenum, silver, titanium, tungsten, chromium, and platinum.

8. The electron emission device of claim 1, wherein the resistance layers are formed at pixel regions defined on the first substrate in one to one correspondence.

9. The electron emission device of claim 1, wherein the resistance layers contact a lateral surface of the electron emission regions.

10. The electron emission device of claim 1, wherein the resistance layers have a specific resistance of $10^6$-$10^{12}$ Ωcm.

11. The electron emission device of claim 1, wherein the electron emission regions are formed with a material selected from the group consisting of carbon nanotube, graphite, graphite nanofiber, diamond, diamond-like carbon, $C_{60}$, and silicon nanowire.

12. The electron emission device of claim 1, further comprising focusing electrodes positioned over the gate electrodes and being electrically insulated from the gate electrodes.

13. The electron emission device of claim 1, further comprising phosphor layers formed on a surface of the second substrate facing the first substrate, and an anode electrode formed on a surface of the phosphor layers.

14. The electron emission device of claim 1, wherein a thickness of the resistance layers is larger than that of the electron emission regions such that a top surface of the resistance layers is placed on a plane higher than a top surface of the electron emission regions.

15. An electron emission device comprising:

a first substrate;

a second substrate facing the first substrate and separated therefrom by a predetermined distance;

a cathode electrode comprising a plurality of first electrodes formed on the first substrate, and a second electrode spaced apart from the plurality of first electrodes;

at least one electron emission region formed on the second electrode;

a resistance layer interconnecting the plurality of first electrodes and the second electrode while surrounding the at least one electron emission region;

an insulating layer positioned over the resistance layer and the cathode electrode; and a gate electrode formed over the insulating layer.

16. The electron emission device of claim 15, wherein the second electrode is formed with a transparent conductive oxide layer.

* * * * *